US007081283B2

(12) United States Patent
Straughn

(10) Patent No.: US 7,081,283 B2
(45) Date of Patent: Jul. 25, 2006

(54) ARTIFICIAL TURF SYSTEM AND METHOD

(76) Inventor: Donnus Straughn, 701 Constantinople St., New Orleans, LA (US) 70115

( * ) Notice: Subject to any disclaimer, the term of this patent is extended or adjusted under 35 U.S.C. 154(b) by 203 days.

(21) Appl. No.: 10/920,931

(22) Filed: Aug. 18, 2004

(65) Prior Publication Data

US 2006/0040073 A1 Feb. 23, 2006

(51) Int. Cl.
*A01N 3/00* (2006.01)

(52) U.S. Cl. ..... 428/17; 156/72

(58) Field of Classification Search ..... 428/17, 428/22, 23, 542.6, 95, 96, 24, 27; 472/92, 472/126

See application file for complete search history.

(56) References Cited

U.S. PATENT DOCUMENTS 6,555,214 B1 * 4/2003 Yates ..... 428/314.4

* cited by examiner

*Primary Examiner*—Jennifer C. McNeil
*Assistant Examiner*—Gordon R. Baldwin
(74) *Attorney, Agent, or Firm*—Juan J. Lizarraga

(57) ABSTRACT

An artificial turf system closely resembling natural grass in both appearance and physical characteristics, which can be removed and re-installed in a relatively short period of time and can be manufactured to suit the particular requirements of any activity, including a variety of sports or other events which would normally be conducted outdoors. The artificial turf system uses strands of synthetic fabric as the upper surface, which strands are attached to a supportive membrane which is carried by a layer of gel material encased in a flexible container supported by a bottom layer of resilient material such as rubber or foam, with the entire system resting on an existing floor surface. It is intended that the bottom surface of the supportive membrane be attached to the top face of the flexible container containing the layer of gel material and the bottom face of the membrane container containing the layer of gel material be attached to the top surface of the bottom layer of resilient material, and the entire artificial turf system can be rolled up for convenient removal and storage and subsequent re-installation. The consistency of the gel material can be varied to suit any particular activity or requirement.

20 Claims, 4 Drawing Sheets

ARTIFICIAL TURF SYSTEM AND METHOD

BACKGROUND OF THE INVENTION

The use of artificial turf has become widespread, particularly in athletic activities. As more and more sports venues are covered or indoor, the use of artificial playing surfaces instead of natural grass or turf has become a necessity. While there may be a preference among athletes to play on a natural surface, the reality is that natural turf is simply not an option in many of the facilities available today. Quite often a facility must be converted from a sports field to a meeting site for a convention and the like. This requires that the playing surface for a particular sport be removable or portable. In certain multi-functional facilities such as covered domes, the facility will host various activities such as football games, musical concerts and trade shows. This requires a very short turnaround time for moving and storing an artificial surface in order to book as many events as possible. Likewise, different sports such as football and baseball may be played in the same facility, requiring a relocation of the playing surface to suit the playing field requirements.

While artificial surfaces are a necessity in many situations, the ultimate desire in most applications is that the artificial surface closely resemble natural grass in appearance and physical characteristics such as texture and color. In addition the artificial surface needs to have the resiliency of natural sod. Unfortunately, most artificial playing surfaces must be placed on hard surfaces such as concrete, so it is difficult to soften the artificial surface to approximate the feel and shock absorbency of grass growing in soil. This is a particular problem in contact sports such as football where players will fall to the ground with great impact.

Another problem with most playing surfaces is that the materials commonly used for these surfaces are plastic and highly abrasive, giving rise to a condition known commonly as "turf burn". Likewise, the traction experienced by the athlete on an artificial surface can give rise to serious leg and knee injuries. In fact, athletes have special shoes to wear on artificial surfaces because the traction characteristics are so different from natural sod.

Therefore, it would be clearly advantageous to have a synthetic surface which closely resembled natural grass, both in appearance and physical characteristics, and which could be removed and re-installed in a relatively short time. It would also be advantageous to have a synthetic surface manufactured to suit the particular requirements of any activity, including a variety of sports or other events, which would normally be conducted outdoors.

SUMMARY OF THE INVENTION

Therefore it is an object of this invention to provide an artificial turf system and method which closely resembles natural grass in both appearance and physical characteristics and which can be removed and re-installed in a relatively short period of time. It is therefore another object of this invention that it be provided in such widths as would allow the artificial turf system to be rolled up and transported either for storage or re-installation with readily available mechanical lifting devices such as a forklift truck.

It is an object of this invention to provide an artificial turf system for use on an existing floor surface comprising; a plurality of synthetic turf strands which may be treated with an aroma inducing agent each having a bottom end and an upper end; a supporting membrane having an upper surface and a lower surface, the bottom end of said turf strands attached to the supporting membrane and the upper end of the turf strands extending above the upper surface of the supporting membrane; a layer of gel material encased in at least one flexible container, said flexible container having an upper face and a lower face, where said upper face is adjacent to and contacts the lower surface of the supporting membrane; a bottom resilient layer having an upper surface and a lower surface, where said bottom resilient layer upper surface is adjacent to and contacts the lower face of the flexible container encasing the gel material layer and where said bottom resilient layer lower surface contacts the existing floor surface.

It is a further object of this invention to provide an artificial turf system wherein the lower surface of the supporting membrane is attached to the upper face of the flexible container and the lower face of the flexible container is attached to the upper surface of the bottom resilient layer.

It is a further object of this invention to provide an artificial turf system wherein the turf strands are folded into a double strand, said double strand having a double top end and a folded bottom end, said folded bottom end is inserted through and attached to the supporting membrane and said double top end extends above the supporting membrane.

It is a further object of this invention to provide a flexible container which comprises a plurality of plastic containers each having an upper face and a lower face, where said upper face is adjacent to and contacts the lower surface of the supporting membrane and the lower face is adjacent to and contacts the upper surface of the bottom resilient layer.

It is a further object of this invention to provide a method of providing an artificial turf system for use on an existing floor surface, comprising the steps of: providing a plurality of synthetic turf strands which may be treated with an aroma inducing agent each having a bottom end and an upper end; providing a supporting membrane having an upper surface and a lower surface and attaching the bottom end of said turf strands to the supporting membrane and having the upper end of the turf strands extending above the upper surface of the supporting membrane; providing a layer of gel material encased in at least one flexible container, said container having an upper face and a lower face, where said upper face is adjacent to and contacts the lower surface of the supporting membrane; and providing a bottom resilient layer having an upper surface and a lower surface, where said bottom resilient layer upper surface is adjacent to and contacts the lower face of the flexible container encasing the gel material layer and where said bottom resilient layer lower surface contacts the existing floor surface.

It is a further object of this invention to provide a method of providing an artificial turf system for use on an existing floor surface further comprising the steps of attaching the lower surface of the supporting membrane is to the upper face of the flexible container and attaching the lower face of the flexible container to the upper surface of the bottom resilient layer.

It is a further object of this invention to provide a method of providing an artificial turf system for use on an existing floor surface further comprising the steps of folding the turf strands into a double strand, said double strand having a double top end and a folded bottom end, and inserting said folded bottom end through and attaching to the supporting membrane with said double top end extending above the supporting membrane.

It is a further object of this invention to provide a method of providing an artificial turf system for use on an existing floor surface wherein the provided flexible container further comprises a plurality of plastic containers each having an upper face and a lower face, where said upper face is adjacent to and contacts the lower surface of the supporting membrane and the lower face is adjacent to and contacts the upper surface of the bottom resilient layer.

It is a further object of this invention that the gel material be specifically mixed to a consistency appropriate to the intended use of the artificial turf system.

DETAILED DESCRIPTION OF THE INVENTION

Figure 1:
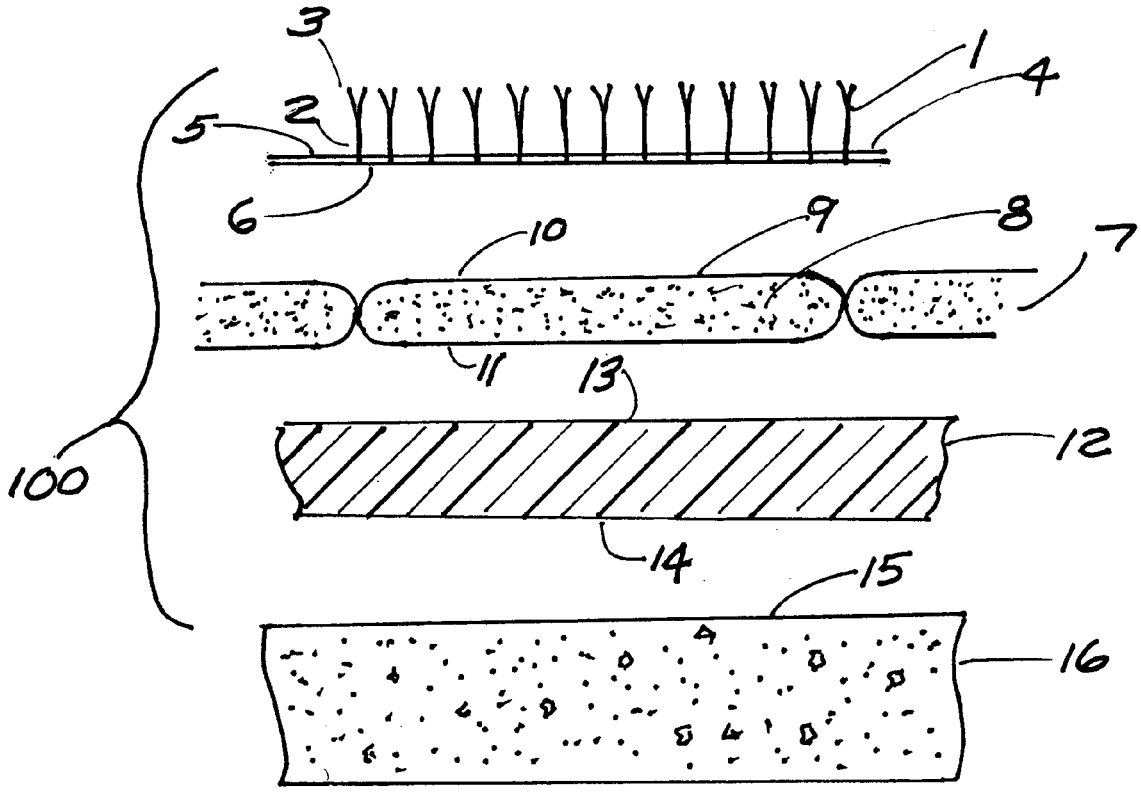
FIG. 1 is an exploded cross-section of the inventive system.

FIG. 1, an exploded cross section of the inventive system 100 depicts a plurality of turf strands 1 each having a bottom end 2 and a top end 3, shown with the bottom 2 fixed to a supporting membrane 4 with an upper surface 5 and a lower surface 6. It is intended that the top end 3 of each turf strand 1 extends above the upper surface 5.

Directly below the lower surface 6 of the supporting membrane 4 is a layer 7 of gel material 8 encased in at least one flexible container 9 having an upper face 10 and a lower face 11. It is intended that the lower surface 6 of the supporting membrane 4 be adjacent to and in contact with the upper face 10 of the flexible container 9, and that, as an alternative embodiment, the lower surface 6 be attached to the upper face 10 by suitable means such as an adhesive compatible with the materials chosen for the supporting membrane 4 and the flexible container 9.

Directly below the layer 7 is a bottom resilient layer 12 having an upper surface 13 and a lower surface 14. It is intended that the lower face 11 of the flexible container 9 be adjacent to and in contact with the upper surface 13 of the bottom resilient layer 12, and that, as an alternative embodiment, the lower face 11 be attached to the upper surface 13 by suitable means such as an adhesive compatible with the materials chosen for the flexible container 9 and the bottom resilient layer 12.

Below the bottom resilient layer 12 is a floor structure 16 which may be concrete, steel or wood having a floor surface 15 which may one of several floor surfaces such as finished concrete, boards, or tile. It is intended that the lower surface 14 of the bottom resilient layer 12 be adjacent to and in contact with the floor surface 15 of the floor structure 16.

Figure 2:
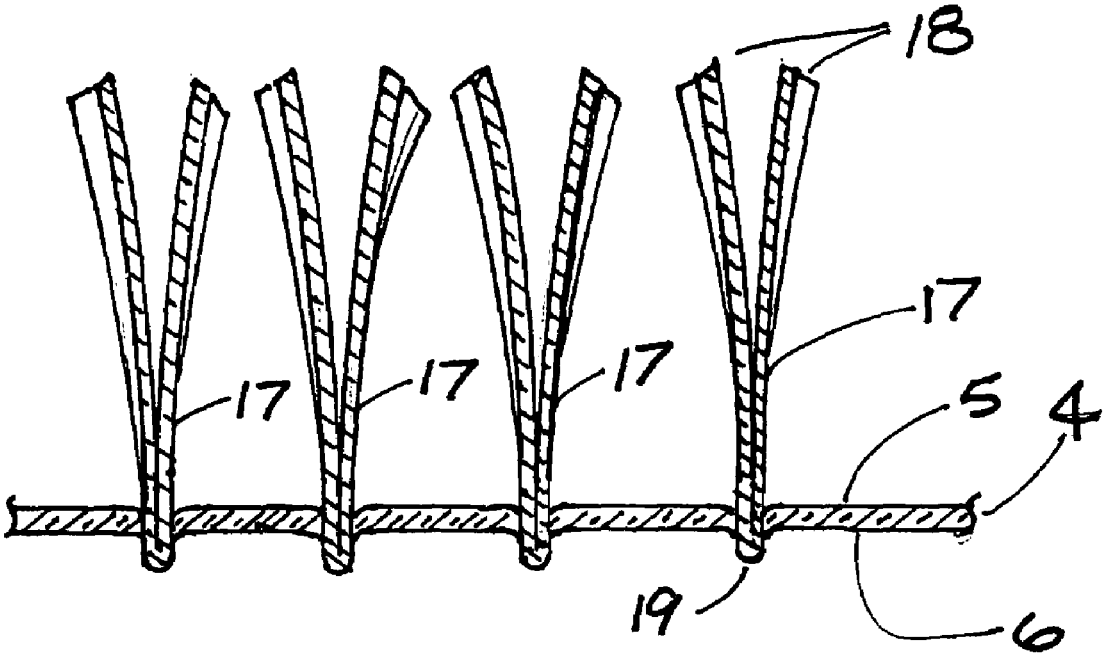
FIG. 2 is a cross section of folded synthetic turf strands attached to a supporting membrane.

FIG. 2 depicts a cross section of one embodiment of the turf strands 1 attached to the supporting membrane 4. In this embodiment, folded turf strands 17 are shown with the folded bottom end 19 stitched to and through the supporting membrane 4 from the upper surface 5 to the lower surface 6. The double top ends 18 of the folded turf strands 17 extend above the supporting membrane 4.

Figure 3:
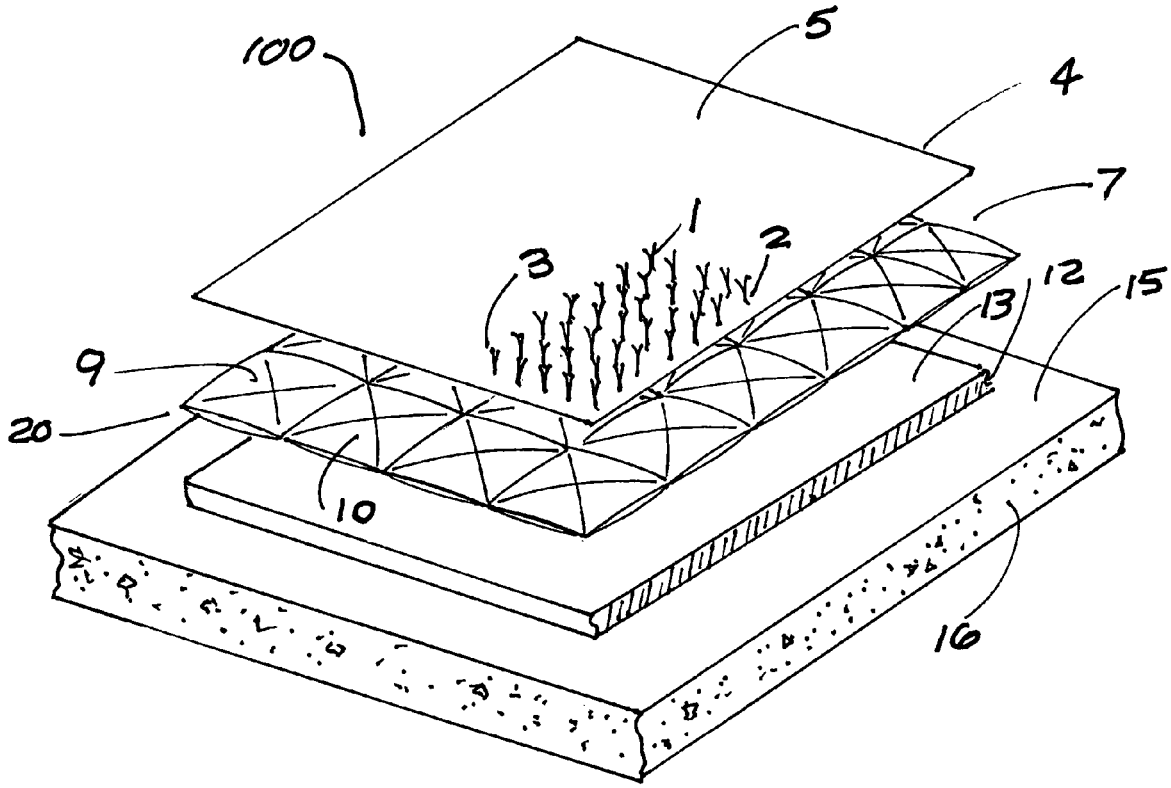
FIG. 3 is an exploded perspective view of the inventive system.

FIG. 3 is an exploded perspective view of the inventive system 100 partially depicting a plurality of turf strands 1 each having a bottom end 2 and a top end 3, shown with the bottom end 2 fixed to a supporting membrane 4 with an upper surface 5 and a lower surface 6 not shown in FIG. 3. As also depicted in FIG. 1, it is intended that the top end 3 of each turf strand 1 extends above the upper surface 5. It is also intended that the turf strands may be spaced at such distance to give the appearance of natural grass growing in soil.

As depicted in FIG. 3, the supporting membrane 4 to which the turf strands 1 are attached is above a layer 7 of gel material 8 encased in a flexible container 9 having an upper face 10 and a lower face 11 not shown in FIG. 3. In the embodiment depicted in FIG. 3, the layer 7 comprises a plurality of flexible containers 20. As also shown in FIG. 1, it is intended that the lower surface 6 of the supporting membrane 4 be adjacent to and in contact with the upper face 10 of the flexible container 9, and that, as an alternative embodiment, the lower surface 6 be attached to the upper face 10 by suitable means such as an adhesive compatible with the materials chosen for the supporting membrane 4 and the flexible container 9.

As also depicted in FIG. 1, directly below the layer 7 is a bottom resilient layer 12 having an upper surface 13 and a bottom surface 14, not shown in FIG. 3. As also shown in FIG. 1, it is intended that the lower face 11 of the flexible container 9 be adjacent to and in contact with the upper surface 13 of the bottom resilient layer 12, and that, as an alternative embodiment, the lower face 11 be attached to the upper surface 13 by suitable means such as an adhesive compatible with the materials chosen for the flexible container 9 and the bottom resilient layer 12.

Below the bottom resilient layer 12 is a floor structure 16 having a floor surface 15. As also shown in FIG. 1, it is intended that the lower surface 14 of the bottom resilient layer 12 be adjacent to and in contact with the floor surface 15 of the floor structure 16.

Figure 4:
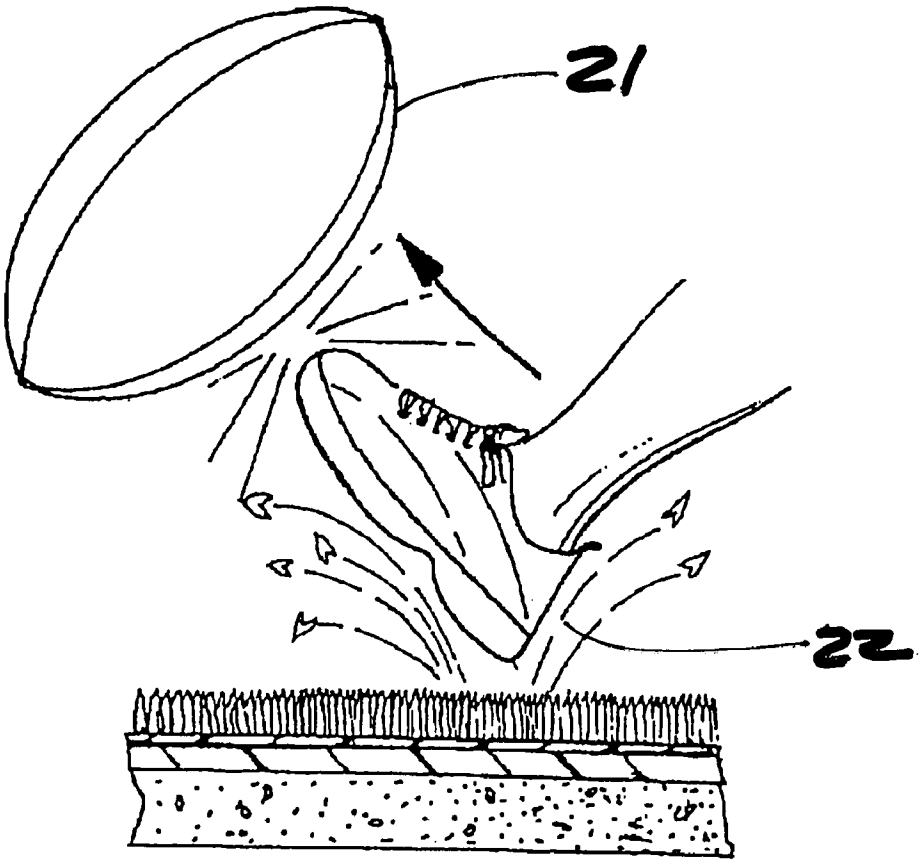
FIG. 4 is a cross section of the inventive system in place during an athletic event.

FIG. 4 is a cross section of the inventive system 100 in place during an athletic event depicting the kicking of a football 21 by the foot 22 of an athlete. The inventive system 100 is shown in place on a floor structure 16.

It is intended that the turf strands 1 be of synthetic material, preferably a synthetic fabric similar to that used for artificial flowers such as polyester or "polysilk", which synthetic material is available in the color of grass or any color desired. Likewise, the turf strands 1 can be treated with an aroma inducing agent to smell like natural grass and be made hypoallergenic. It is also intended that the turf strands can be supplied for use in the inventive system in continuous rolls of fabric tape in a width approximately the same as a blade of grass, preferably about 0.25 inch in width.

The supporting membrane 4 to which the bottom end 2 of each turf strand 1 is attached is intended to be a heavy duty tear resistant synthetic sheet such as woven polypropylene or other suitable synthetic fabric such as Nylon, Dacron® or Kevlar®.

Although the turf strands 1 can be attached to the supporting membrane as single strands cut to an appropriate length to approximate the length of a blade of grass, anywhere from one to four inches, a preferred method of attachment is depicted in FIG. 2 where the bottom end 19 of a folded turf strand 17 is attached to the supporting membrane 4 by a sewing technique which pierces the supporting membrane 4 with a needle threaded with turf strand material. Once the bottom end 19 has been carried through the supporting membrane 4 by the needle, the needle is withdrawn and the folded turf strand 17 is left in place in the supporting membrane 4. The folded turf strands 17 can be cut to the desired length after placement in the supporting membrane 4 and the double top ends 18 can be cut on an angle to resemble a natural blade of grass. It is also preferable that the sewing technique be performed by a multiplicity of needles spaced to the desired distance to provide the required density of turf strands 1 per square unit area of the supporting membrane 4. While not shown, an adhesive compound can be used alone or in combination with a sewing technique to attach the bottom ends 2 of the turf strands 1 to the supporting membrane 4.

As depicted in FIGS. 1 and 3, directly below the supporting membrane 4, is a layer 7 of gel material 8 encased in at least one flexible container 9 with an upper face 10 and lower face 11. It is intended that the flexible container 9 be sealed to contain the gel material 8 and that the upper face 10 and lower face 11 be of a heavy synthetic sheet such as polypropylene sealed at the edges to form a "bag-like" structure. FIG. 3 shows a preferred embodiment wherein the flexible container 9 comprises a plurality of flexible containers 20. One possible product available for the plurality of flexible containers 20 is a 6 mil polybag of polypropylene material of 12 inch by 12 inch nominal dimensions, although bags of different synthetic materials such as Nylon® could be used.

It is intended that the gel material 8 contained in the flexible container be compounded to a consistency needed for the level of resilience required for the intended use of the inventive system 100. One example of a suitable material is the dry polymer LiquiBlock™ AT-03S, mixed with water. If needed, an appropriate anti-freeze compound can be added to the water.

The bottom layer of the inventive system 100 is the bottom resilient layer 12 is intended to be a continuous solid layer of an elastomer such as foam rubber or any resilient material to serve as a backing for the inventive system 100, which backing will lie on the floor surface 15 over which the inventive system 100 is installed.

Although not shown in the Figures, it is intended that the inventive system 100 comprising turf strands 1, supporting membrane 4, layer 7 of gel material encased in flexible containers 9 and a bottom resilient layer 12, be of such thickness and flexibility that the entire inventive system 100 be capable of rolling up upon itself just as a carpet or rug for removal and transportation to and from a storage area.

I claim:

1. An artificial turf system for use on an existing floor surface comprising:

a. a plurality of synthetic turf strands each having a bottom end and an upper end;

b. a supporting membrane having an upper surface and a lower surface, the bottom end of said turf strands attached to the supporting membrane and the upper end of the turf strands extending above the upper surface of the supporting membrane;

c. a gel material layer encased in at least one flexible container, said container having an upper face and a lower face, where said upper face is adjacent to and contacts the lower surface of the supporting membrane;

d. a bottom resilient layer having an upper surface and a lower surface, where said bottom resilient layer upper surface is adjacent to and contacts the lower face of the flexible container encasing the gel material layer and where said bottom resilient layer lower surface contacts the existing floor surface.

2. An artificial turf system according to claim 1 wherein the lower surface of the supporting membrane is attached to the upper face of the flexible container and the lower face of the flexible container is attached to the uppersurface of the bottom resilient layer.

3. An artificial turf system according to claim 2 wherein the turf strands are folded into a double strand, said double strand having a double top end and a folded bottom end, said folded bottom end inserted through and attached to the supporting membrane with said double top end extending above the supporting membrane.

4. An artificial turf system according to claim 3 where the synthetic turf strands are treated with an aroma inducing agent.

5. An artificial turf system according to claim 2 wherein the flexible container comprises a plurality of plastic containers each having an upper face and a lower face, where said upper face is adjacent to and contacts the lower surface of the supporting membrane and the lower face is adjacent to and contacts the upper surface of the bottom resilient layer.

6. An artificial turf system according to claim 2 where the synthetic turf strands are treated with an aroma inducing agent.

7. An artificial turf system according to claim 1 wherein the turf strands are folded into a double strand, said double strand having a double top end and a folded bottom end, said folded bottom end inserted through and attached to the supporting membrane with said double top end extending above the supporting membrane.

8. An artificial turf system according to claim 7 where the synthetic turf strands are treated with an aroma inducing agent.

9. An artificial turf system according to claim 1 wherein the flexible container comprises a plurality of plastic containers each having an upper face and a lower face, where said upper face is adjacent to and contacts the lower surface of the supporting membrane and the lower face is adjacent to and contacts the upper surface of the bottom resilient layer.

10. An artificial turf system according to claim 1 where the synthetic turf strands are treated with an aroma inducing agent.

11. A method of providing an artificial turf system for use on an existing floor surface, comprising the steps of:

a. providing a plurality of synthetic turf strands each having a bottom end and an upper end;

b. providing a supporting membrane having an upper surface and a lower surface and attaching the bottom end of said turf strands to the supporting membrane and having the upper end of the turf strands extending above the upper surface of the supporting membrane;

c. providing a gel material layer encased in at least one flexible container, said container having an upper face and a lower face, where said upper face is adjacent to and contacts the lower surface of the supporting membrane;

d. providing a bottom resilient layer having an upper surface and a lower surface, where said bottom resilient layer upper surface is adjacent to and contacts the lower face of the flexible container encasing the gel material layer and where said bottom resilient layer lower surface contacts the existing floor surface.

12. The method of claim 11 further comprising the steps of attaching the lower surface of the supporting membrane to the upper face of the flexible container and attaching the lower face of the flexible container to the upper surface of the bottom resilient layer.

13. The method of claim 12 further comprising the steps of folding the turf strands into a double strand, said double strand having a double top end and a folded bottom end, and inserting said folded bottom end through and attaching to the supporting membrane with said double top end extending above the supporting membrane.

14. The method of claim 13 further comprising the step of providing synthetic turf strands treated with an aroma inducing agent.

15. The method of claim 12 wherein the provided flexible container further comprises a plurality of plastic containers each having an upper face and a lower face, where said upper face is adjacent to and contacts the lower surface of the supporting membrane and the lower face is adjacent to and contacts the upper surface of the bottom resilient layer.

16. The method of claim 12 further comprising the step of providing synthetic turf strands treated with an aroma inducing agent.

17. The method of claim 11 further comprising the steps of folding the turf strands into a double strand, said double strand having a double top end and a folded bottom end, and inserting said folded bottom end through and attaching to the supporting membrane with said double top end extending above the supporting membrane.

18. The method of claim 17 further comprising the step of providing synthetic turf strands treated with an aroma inducing agent.

19. The method of claim 11 wherein the provided flexible container further comprises a plurality of plastic containers each having an upper face and a lower face, where said upper face is adjacent to and contacts the lower surface of the supporting membrane and the lower face is adjacent to and contacts the upper surface of the bottom resilient layer.

20. The method of claim 11 further comprising the step of providing synthetic turf strands treated with an aroma inducing agent.

* * * * *